United States Patent [19]

Cummings

[11] Patent Number: 4,464,162

[45] Date of Patent: Aug. 7, 1984

[54] CENTRIFUGAL SEPARATOR

[75] Inventor: John R. Cummings, North Abington, Mass.

[73] Assignee: Bird Machine Company, Inc., South Walpole, Mass.

[21] Appl. No.: 478,220

[22] Filed: Mar. 24, 1983

[51] Int. Cl.[3] ..... B04B 11/08

[52] U.S. Cl. ..... 494/53; 494/57

[58] Field of Search ..... 210/538, 540; 494/50, 494/52, 53, 56, 57, 66

[56] References Cited

U.S. PATENT DOCUMENTS

| | | | |
|---|---|---|---|
| 884,830 | 4/1908 | Lindahl . | |
| 2,242,713 | 5/1941 | Tholl | 233/22 |
| 2,398,967 | 4/1946 | Schutte | 210/68 |
| 3,187,997 | 6/1965 | Gooch | 233/7 |
| 3,279,687 | 10/1966 | Amero | 494/56 |
| 3,279,688 | 10/1966 | Cook | 233/7 |
| 3,321,131 | 5/1967 | Cook | 233/7 |
| 3,333,765 | 8/1967 | Maurer | 233/22 |
| 3,623,656 | 11/1971 | Lavanchy | 233/7 |

*Primary Examiner*—Robert W. Jenkins
*Assistant Examiner*—Arthur D. Dahlberg
*Attorney, Agent, or Firm*—Edgar H. Kent

[57] ABSTRACT

A centrifugal separator having a rotary bowl for receiving feed which forms a pool within the bowl a skimmer movably mounted to fixed structure within the bowl for removing liquid from the pool to a discharge system with an outlet external to the bowl, and adjustment means operable from outside the bowl for adjustably moving the skimmer oppositely toward and away from the bowl axis to vary the pool depth. However, in accordance with the invention, the skimmer adjustment means includes skimmer mounting means movably connecting the skimmer to the fixed structure within the bowl so as to enable adjustment movements thereof by the adjustment means and so that the hydraulic thrust of the pool liquid against the skimmer is applied by the mounting means substantially entirely to the fixed structure. Preferably, the adjustment movement of the skimmer enabled by the mounting means are essentially radial only to the axis of the bowl, thus greatly reducing the amount of adjustment movement required.

29 Claims, 9 Drawing Figures

FIG 3
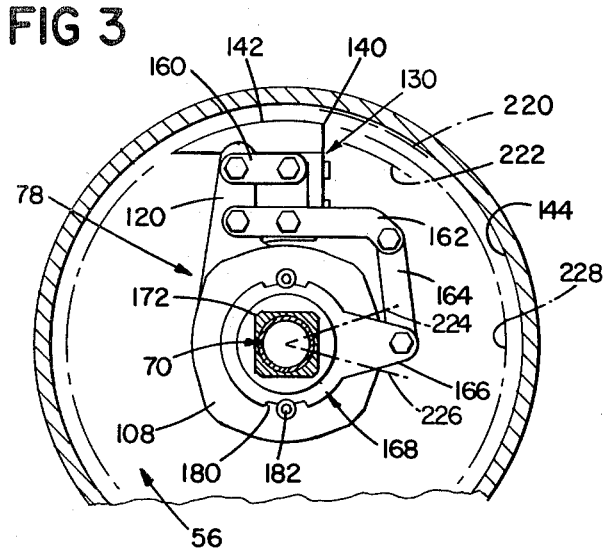
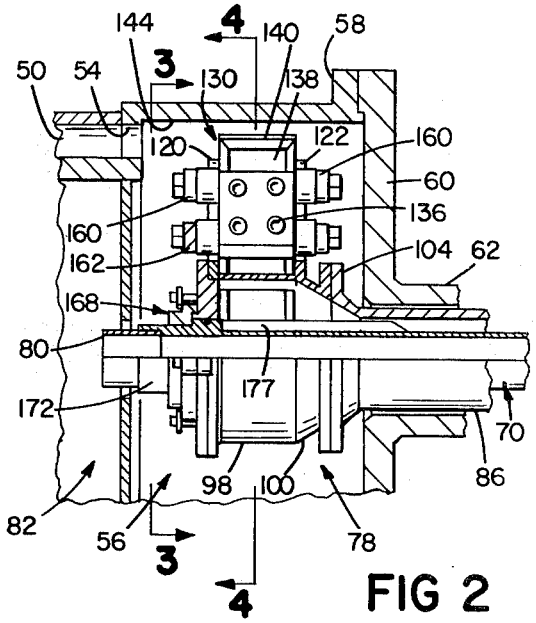
FIG 2
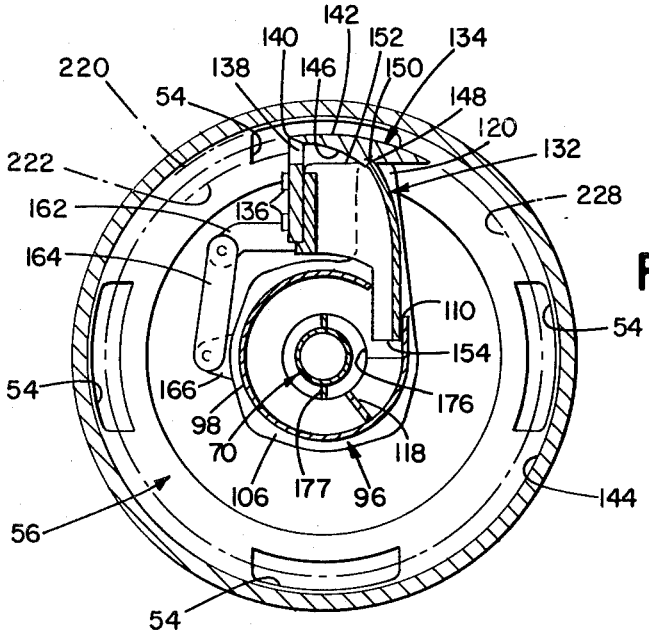
FIG 4
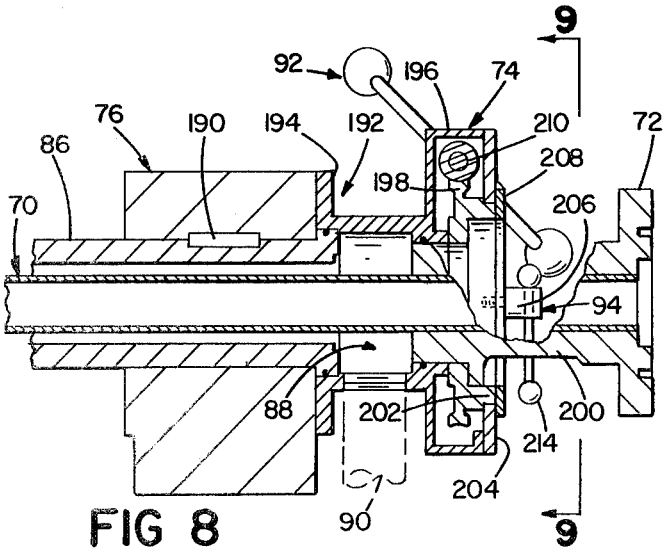
FIG 8
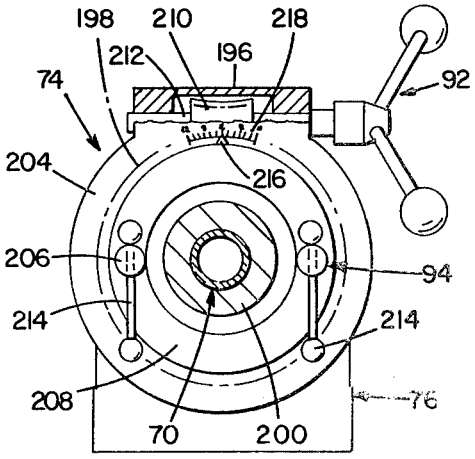
FIG 9

CENTRIFUGAL SEPARATOR

BACKGROUND OF THE INVENTION

1. Field of the Invention

This invention relates to centrifuge pool skimmer mechanism for removing a liquid fraction from the pool inside the rotating bowl of the centrifuge. The mechanism is adjustable from outside the bowl to vary the pool depth while the machine is operating.

2. Description of the Prior Art

U.S. Pat. No. 3,279,688 discloses skimmer mechanism for the purpose concerned, installed in a centrifuge of a solids-liquid separating type with rotary conveyor. A pool skimmer is rotatably mounted by a sleeve on a fixed support tube overhanging its support and extending axially into the bowl, to which tube the skimmer discharges. The axis of rotation of the sleeve is eccentric to the axis of the bowl, so that rotation about the eccentric axis of the sleeve moves the skimmer at an angle between radial and circumferential to the bowl axis to effect the desired adjustment of the skimmer in a direction radial to the bowl axis. This varies the depth of immersion of the skimmer inlet in the pool and correspondingly varies pool depth. The skimmer sleeve is rotated by connection to an axial feed pipe which is rotatable from outside the bowl.

The patented device described has been used extensively and operates satisfactorily under normal conditions. However, when the centrifuge has been operated at high speed and throughput, a severe vibration problem has been encountered in the skimmer mechanism, so severe as to pound the holding and adjusting surfaces of the skimmer mechanism to destruction in a short time. The problem persisted even though the overhung length of the fixed support tube for the skimmer was greatly reduced by moving the tube and skimmer from the solids discharge end as shown in the patent to the opposite end of the bowl.

BRIEF DESCRIPTION OF THE INVENTION

It is an object of the invention to provide improved skimmer mechanism which overcomes, or at least greatly mitigates, the aforesaid vibration problem. Another object is to provide such a mechanism in which the extent of movement of the skimmer required for a given range of pool depth adjustment is substantially reduced.

It has been discovered that damaging vibration in the skimmer mechanism, at operation even at highest rated speed and throughput, is suppressed by providing an adjustably movable skimmer mounting which is connected to fixed support structure within the bowl so that the hydraulic thrust of the pool liquid against the skimmer is applied through the mounting substantially entirely to the fixed structure. The successful suppression of vibration attained by such a mounting appears to show that the previously unknown cause of the vibration problem with the prior art mechanism was that, due to the rotatable mounting of the skimmer on the fixed support structure, the hydraulic thrust of the pool against the skimmer was mostly exerted on the relatively weakly resistant rotary feed pipe and connections of the skimmer thereto.

Accordingly, a centrifugal separator according to the invention has, as in the prior art, a rotary bowl for receiving feed which forms a pool within the bowl, a skimmer movably mounted to fixed structure within the bowl for removing liquid from the pool to a discharge system with an outlet external to the bowl, and adjustment means operable from outside the bowl for adjustably moving the skimmer oppositely toward and away from the bowl axis to vary the pool depth. However, in accordance with the invention, the skimmer adjustment means includes skimmer mounting means movably connecting the skimmer to the fixed structure within the bowl so as to enable adjustment movements thereof by the adjustment means and so that the hydraulic thrust of the pool liquid against the skimmer is applied by the mounting means substantially entirely to the fixed structure. Preferably, the adjustment movements of the skimmer enabled by the mounting means are essentially radial only to the axis of the bowl, thus greatly reducing the amount of adjustment movement requi red as compared to the prior art device discussed above, a feature of particular importance where adjustment is effected by rotation of a feed pipe which must be rotatably connected to fixed source piping.

In preferred embodiments, also, the skimmer mounting means comprises linkage pivoted to the fixed support structure, preferably to at least one portion of the fixed structure adjacent the inner surface of the pool; the linkage may be pivotally connected both to the skimmer and to portions of the support structure, at opposite sides thereof, by two pairs of links spaced radially of the bowl axis, one of which may serve as a connecting link to an operating member having a portion external to the bowl; and the skimmer includes a duct which discharges the removed liquid into an inlet to the external discharge system in which the duct is movable radially of the bowl axis (to enable radial adjustment movement of the skimmer).

In the preferred embodiment selected to illustrate the invention, the centrifuge is of the solids-liquid separating type with rotary conveyor for moving separated solids to a discharge port, the skimmer is disposed within an annular compartment in the conveyor extending into the pool and open thereto, the fixed structure is part of a tubular member fixedly mounted externally of the bowl and extending axially into it, and the tubular member forms part of the discharge system together with a rotatably mounted, axial feed pipe which forms the operating member of the adjustment means and is provided with adjustment rotation mechanism outside the bowl.

Other features and advantages will be seen as the following description of a particular embodiment progresses, in conjunction with the drawings, in which:

FIG. 2 is a side view, partially in section, of the skimmer compartment portion of the centrifuge shown in FIG. 1;

Figure 1:
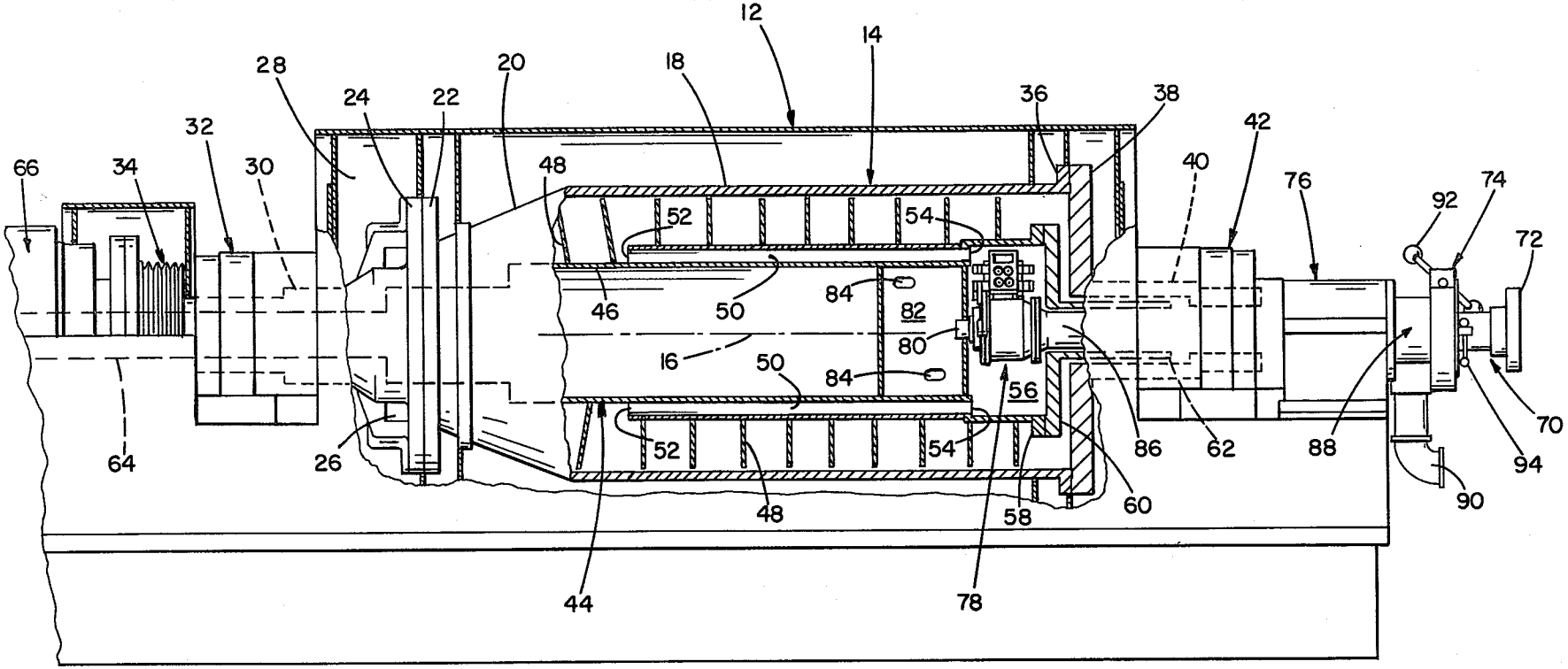
FIG. 1 is a side view, partially in section, showing aspects of a centrifuge system in accordance with the invention.
Figure 5:
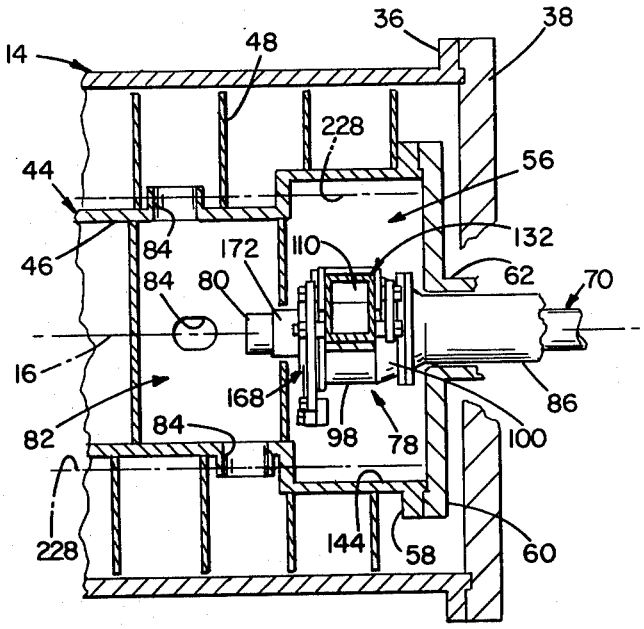
Figure 6:
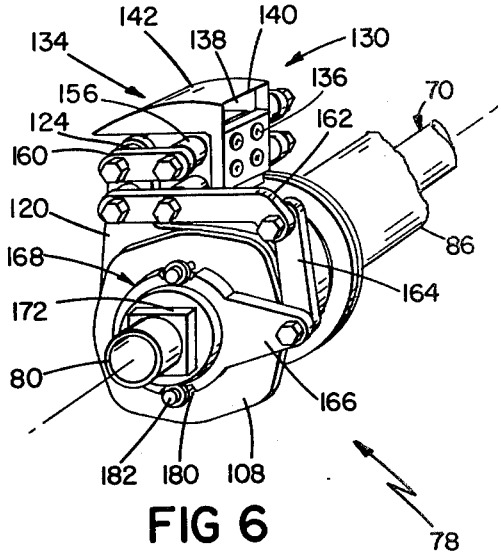
Figure 7:
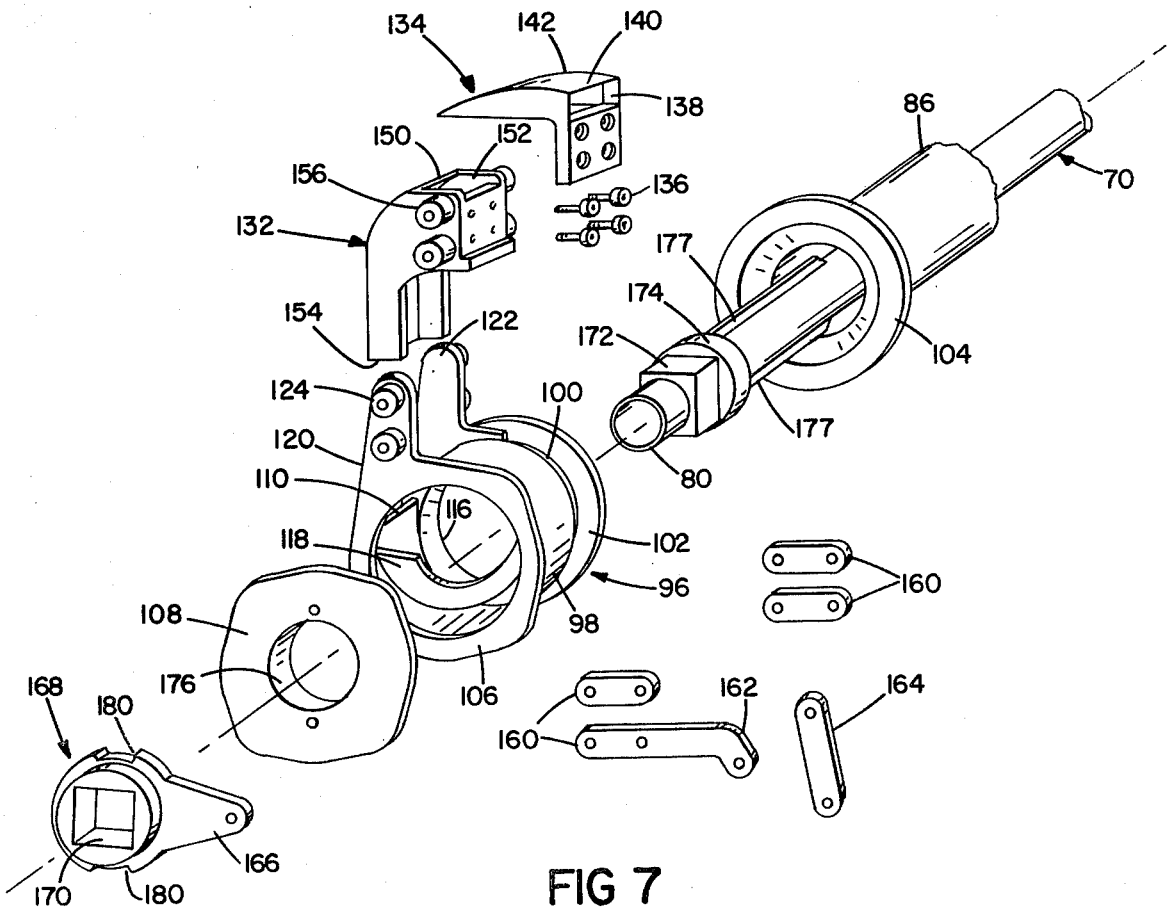

FIGS. 3 and 4 are sectional views taken along the lines 3—3 and 4—4 respectively of FIG. 2;

FIG. 5 is a plan view of portions of the centrifuge bowl, conveyor, and skimmer compartment of the centrifuge system shown in FIG. 1, with portions in section;

FIG. 6 is a perspective view of skimmer apparatus employed in the centrifuge of FIG. 1;

FIG. 7 is an exploded perspective view of the skimmer apparatus shown in FIG. 6;

FIG. 8 is a sectional side view of the skimmer apparatus support and adjusting mechanism, with portions of flange member 200 and pipe 70 being broken away to show aspects of the lock mechanism 94; and FIG. 9 is an end view of the adjusting mechanism taken along the line 9—9 of FIG. 8.

DESCRIPTION OF PARTICULAR EMBODIMENT

The centrifuge shown in FIG. 1 has a housing 12 in which centrifuge bowl 14 is mounted for rotation about centrifuge axis 16. Bowl 14 has a length of about six feet and includes cylindrical section 18 that has an inner diameter of about two feet and a conical section 20 (that tapers at an angle of about ten degrees to the centrifuge axis 16). Secured to bowl flange 22 is solids end bowl head 24 which has openings 26 through which solids are discharged into compartment 28 and an integral shaft portion 30 that is supported in pedestal bearing 32 and connected to drive sheave 34. Secured to bowl flange 36 at the opposite end of bowl 14 is liquids end bowl head 38 which has an integral shaft portion 40 that is supported in pedestal bearing 42.

Mounted within bowl 14 for rotation about the centrifuge axis is conveyor 44 that includes a cylindrical hub 46 on which is disposed a continuous outwardly projecting helical vane flight 48 with a first cylindrical section that cooperates with the cylindrical bowl section 18 and a frustoconical section that cooperates with the tapered bowl section 20. Four axially extending return tubes 50 are secured to conveyor hub 46 and extend along the length of the cylindrical section of the bowl from entrance ports 52 at one end to discharge ports 54 that communicate with skimmer chamber 56. Secured to conveyor flange 58 is head structure 60 that defines one wall of skimmer compartment 56 and has trunnion 62 that extends into and is supported within bowl shaft 40. A similar conveyor trunnion 64 extends through bowl shaft 30 and drive sheave 34 into speed change gear box 66. Sheave 34 drives bowl 14 at an operating speed of 3000 rpm and (via gear box 66 and trunnion 64) also drives conveyor 44 in the same direction as bowl 14 and a small differential rpm to bowl speed, in this instance at slightly slower rpm.

Slurry to be processed is introduced into the centrifuge through feed pipe 70 which extends from flange 72 through gear case 74, fixed pedestal support 76, bearing 42 and skimmer apparatus 78 in skimmer compartment 56 to a discharge end 80 that is disposed in feed compartment 82 within conveyor hub 46 that has ports 84 for discharging the slurry feed material into the centrifuge bowl 14.

Fixed tubular discharge conduit 86 supports skimmer apparatus 78 in cantilever fashion, conduit 86 extending from fixed support 76 through pedestal bearing 42 and conveyor trunnion 62 to skimmer apparatus 78; and communicates with discharge chamber 88 which has an outflow through discharge pipe 90. Gear case 74, which is also supported in cantilever fashion from pedestal 76, houses a gear that is coupled to feed pipe 70 and that is rotated by adjusting mechanism 92 and locked by clamping mechanism 94.

Further details of skimmer apparatus 78 may be seen with reference to FIGS. 2-7. As shown in the exploded view of FIG. 7, that apparatus includes a housing unit 96 that has a cylindrical body section 98 and a tapered end section 100. Flange 102 on tapered end section 100 is bolted to flange 104 of tubular discharge conduit 86, and flange 106 on cylindrical section 98 is bolted to end plate 108. An inlet port 110 is formed in cylindrical section 98 and tapered section 100 defines an outlet port 116. Guide vane 118 is fixed within housing 96 and directs flow of liquid from inlet port 110 to outlet port 116.

Fixed to and upstanding from cylindrical section 98 are two support arms 120, 122, each of which carries two spaced stub posts 124. Disposed between support arms 120, 122 is a skimmer assembly 130 that includes a flow directing duct or channel member 132 and an inlet member 134 which is secured to channel member 132 by bolts 136. Inlet member 134 has a rectangular inlet port 138 in the upper portion of its front wall, with a lip 140 at the upper edge of port 138. Extending rearwardly from lip 140 is curved outer surface 142 that corresponds to the curvature of the inner surface 144 of skimmer compartment 56, and a curved inner surface 146 (FIG. 4) that extends rearwardly to ridge 148 which seats against the rear edge 150 of the inlet port 152 of channel member 132 as indicated in FIG. 4. Channel 132 extends downwardly from port 152 to a discharge end 154 which is disposed in inlet port 110 of housing 96 as indicated in FIG. 4.

With reference again to FIG. 7, on the side walls of channel member 132 are spaced projecting posts 156 that correspond to posts 124 on arms 120, 122. Two pairs of support links 160 are bolted to and extend between the corresponding posts 124, 156 in a parallelogram type of support linkage for the skimmer channel subassembly. One lower link 160 has an extension 162 that is connected by coupling link 164 to arm 166 of wrench member 168. Received in square socket 170 of wrench member 168 is square drive flange 172 of feed pipe 70, that feed pipe also having a cylindrical portion 174 that is supported for rotation in cylindrical opening 176 in chamber end plate 108. Axially extending webs 177 on feed pipe 70 facilitate assembly of pipe 70 in chamber 96. Notches 180 on the flange of wrench 168 cooperate with studs 182 and limit the range of angular movement of wrench 168 to about twenty degrees, as indicated in chain line in FIG. 3.

Details of the skimmer apparatus support and adjustment mechanism may be seen with reference to FIGS. 8 and 9. Discharge conduit 86 extends from the outlet port 116 of housing 96 through fixed pedestal support 76 to discharge chamber 88 and is locked against rotation by key 190 in pedestal assembly 76. Also supported in cantilever fashion from pedestal 76 is a tubular member 192 that defines discharge chamber 88 and has a flange 194 that is bolted to pedestal 76 and a casing portion 196 of greater diameter that forms side and peripheral walls of gear housing 74. Disposed in housing 74 is cylindrical gear 198 that is fixed to tubular extension 200 of flange 72 which in turn is fixed to feed tube 70. Gear 198 has an axially extending ring 202 on which the inner periphery of gear housing end plate 204 is seated. Fixed to ring 202 by clamp studs 206 is clamp disk 208. Worm gear 210 is supported on shaft 212 in the upper part of gear case 74 and is driven by adjusting handle 92 to rotate gear 198. Each clamp assembly 94 includes a handle member 214 that is carried by clamp stud 206 for tightening the clamp studs and seating ring 208 clamp against cover plate 204 and lock gear 198 and feed tube 70 relative to support tube 86 and pedestal support 76. When the clamp mechanism 94 is released, adjusting assembly 92 may be operated to drive the transverse worm gear 210, thus rotating feed pipe 70 relative to fixed pedestal 76 and discharge conduit 86. The rotational position of feed pipe 70 is indicated by pointer 216 carried by clamp plate 208 that cooperates with scale 218 on cover plate 204 of gear housing 74.

With reference to FIGS. 3 and 4, such rotation of feed pipe 70 relative to discharge conduit 86 rotates wrench 168, and that movement through drive linkage 160, 162, 164, shifts the radial position of skimmer lip 140 relative to compartment surface 144. The permitted twenty degree rotation moves lip 140 between a minimum pool depth position 220 and a maximum pool depth position 222.

The radial position of skimmer lip 140 in skimmer compartment 56 thus controls the level of the pool in the centrifuge bowl 14. In this embodiment, the skimmer lip 140 can be moved radially ¾ inch between a minimum pool level 220 (FIGS. 3 and 4) (zero on scale 218 and angular position 224 of feed pipe 70 — FIG. 3) and a maximum pool level 222 (twelve on scale 218 and feed pipe angular position 226).

In operation of the centrifuge, bowl 14 is driven in rotation at 3000 rpm. A feed mixture of liquid and solid particles is introduced through feed pipe 70 into feed chamber 82 and flows through the ports 84 in the spinning conveyor 44 into bowl 14. Under the influence of centrifugal force, the feed mixture forms a layer against the inner wall of the bowl, the solid particles being urged by reason of their higher specific gravity to form a layer immediately next to the face of the bowl while the lighter liquids tending to rise towards the center of the bowl and form a pool surface 228. Differential rotation of bowl 14 and conveyor 44 cuases the conveyor vane 48 to advance the solids settling towards the bowl wall axially towards the reduced diameter left-hand end of the bowl 14 for discharge through openings 26 into discharge compartment 28. The pool liquid flows into the inlet ports 52 of return tubes 50 for discharge through ports 54 into skimmer compartment 56. The depth of the pool liquid against wall 144 of skimmer compartment 56 remains substantially constant as long as the radial position of lip 140 of the skimmer subassembly remains constant and so long as the skimmer has capacity to remove liquid at the rate that it is being introduced through the feed pipe. Liquid flows over lip 140 into skimmer duct channel 132 and is discharged into chamber 96. Vane 118 directs the skimmed liquid through port 116 to discharge pipe 86 for flow to compartment 88 and out conduit 90.

The depth of pool 228 is changed by adjusting the radial position of skimmer lip 140. That adjustment is accomplished by release of lock assemblies 94 and operation of adjusting mechanism 92 to rotate gear 198 which in turn rotates feed pipe 70 and wrench 168 to move the support links 160 and shift the radial position of skimmer lip 140 relative to the fixed and stably supported skimmer chamber structure.

While a particular embodiment of the invention has been shown and described, various modifications will be apparent to the those skilled the art, and therefore it is not intended that the invention be limited to the disclosed embodiment or details thereof, and departures may be made therefrom within the spirit and scope of the invention. For example, the particular form and dimensions of the centrifuge disclosed are largely environmental to the invention and are subject to change in many respects. So also dimensions and adjustment ranges given for the preferred skimmer mechanism are illustrative; others can be used. The linkage of the skimmer mechanism is preferred but can be substituted by substituting slide mounting of the skimmer to the side support arms, with adequate wiping to prevent solids build up where a significant amount of solids is suspended in the pool liquid. Two sets of linkage, one at each side of the skimmer connected to opposite support arms is preferred for greater strength and stability as compared with a single set at one side linked to a single support.

What is claimed is:

1. In a centrifugal separator having a rotary bowl for receiving feed which forms a pool in the bowl, a skimmer movably mounted to fixed support structure within the bowl having an inlet for removing liquid from the pool and an outlet for said removed liquid to a discharge system with an outlet external to the bowl, and adjustment means operable from outside the bowl for adjustably moving said skimmer oppositely toward and away from the bowl axis to vary the amount of liquid retained in the pool;

the improvement wherein said adjustment means comprises (a) skimmer mounting means within said bowl at one side of the bowl axis movably connecting said skimmer to said fixed support structure at said side of said bowl axis so as to enable said adjustment movements thereof by said adjustment means and so that the hydraulic thrust of the pool liquid against said skimmer is applied by said mounting means substantially entirely to said fixed support structure, and (b) connection means movalby connecting said skimmer outlet to said discharge system for movement relative to said system toward and away from the bowl axis in accordance with adjustment movements of said skimmer by said adjustment means.

2. A centrifuge according to claim 1 wherein said skimmer mounting means comprises linkge pivoted to said fixed support structure.

3. A centrifugal separator according to claim 2 wherein said fixed support structure has at least one portion adjacent the radially inner surface of the pool to which said linkage is pivoted.

4. A centrifugal separator according to claim 3 wherein said linkage includes at least one pair of links pivoted to said support portion at points spaced radially of the bowl axis.

5. A centrifugal separator according to claim 4 wherein said fixed structure portion has spaced apart elements disposed at either side of said skimmer and said linkage includes two pairs of said links pivotally connecting opposite sides of said skimmer to said elements, respectively.

6. A centrifugal separator according to claim 5 wherein said links are pivoted both to said support structure and to said skimmer.

7. A centrifugal separator according to claim 6 wherein said links of each pair are pivoted to said skimmer at points spaced radially of the axis of said bowl.

8. A centrifugal separator according to claim 7 wherein said adjustment means includes a moveable adjustment member within the bowl operatively pivoted to said linkage.

9. A centrifugal separator according to claim 8 wherein said separator comprises a rotary conveyor for moving solids settling in the bowl to a discharge outlet therefor from the bowl, and said skimmer is disposed within an annular compartment formed in said conveyor, said compartment extending into the pool and having an inlet for liquid therefrom.

10. A centrifugal separator according to claim 2 wherein said adjustment means includes a moveable adjustment member within the bowl operatively pivoted to said linkage.

11. A centrifugal separator according to claim 10 wherein said adjustment member is rotary.

12. A centrifugal separator according to claim 11 wherein said adjustment member is a feed pipe.

13. A centrifugal separator according to claim 11 wherein said adjustment member is pivoted to a link which is also pivoted to said skimmer and to said fixed support structure.

14. A centrifugal separator according to claim 1 wherein said separator comprises a rotary conveyor for moving solids settling in the bowl to a discharge outlet therefor from the bowl, and said skimmer is disposed within an annular compartment formed in said conveyor, said compartment extending into the pool and having an inlet for liquid therefrom.

15. A centrifugal separator according to claim 1 wherein the adjustment movements of said skimmer enabled by said mounting means are essentially only radial to the axis of said bowl.

16. A centrifugal separator according to claim 15 wherein said connection means comprises a duct in said skimmer defining said skimmer outlet and an inlet to said discharge system disposed within the bowl, said duct extending into said discharge system inlet and being movable within it radially of the bowl axis.

17. A centrifugal separator according to claim 16 wherein said adjustment means includes an adjustment member having a rotary portion within the bowl and said mounting means comprises a link pivoted to said rotary portion, to said skimmer and to said fixed structure.

18. A centrifugal separator according to claim 17 wherein said fixed structure has at least one portion adjacent the radially inner surface of the pool and said mounting means comprises at least one link pivoted to said portion and to said skimmer.

19. A centrifugal separator according to claim 18 wherein said separator comprises a rotary conveyor for moving solids settling in the bowl to a discharge outlet therefor from the bowl, and said skimmer is disposed within an annular compartment formed in said conveyor, said compartment extending into the pool and having an inlet for liquid therefrom.

20. A centrifugal separator according to claim 19 wherein said fixed structure comprises a tubular member fixedly mounted externally of the bowl and extending axially into the bowl, said tubular member forming part of said discharge system.

21. A centrifugal separator having a bowl with an annular treating zone within the outer portion of the bowl, means for rotating said bowl about an axis for forming material within said zone into an annular pool to subject material in said pool to centrifugal force treatment, a rotary conveyor in said bowl for moving solids settling in said pool to a discharge outlet therefor from the bowl, feed means for supplying material flowable as a liquid to be treated to said annular treating zone, an annular compartment formed in said conveyor, said compartment extending into said pool and having an inlet for liquid therefrom, structure within said compartment defining an inlet to a discharge system for receiving material flowable as a liquid from said pool while said bowl is rotating and flowing said material to an outlet external to said bowl, a skimmer within said compartment having an inlet for removing liquid from said pool and an outlet for said removed liquid to said inlet of said discharge system, fixed support structure in said compartment, skimmer mounting means within said bowl at one side of the bowl axis movably connecting said skimmer to said fixed support structure at said side of said bowl axis so as to enable adjustment movements thereof and so that the hydraulic thrust of the pool liquid against said skimmer is applied by said mounting means substantially entirely to said fixed support structure, adjustment means operable from outside said bowl for adjustably moving said skimmer oppositely toward and away from the bowl axis to vary the amount of liquid retained in said pool, and connection means movably connecting said skimmer outlet to said inlet to said discharge system for movement relative to said system toward and away from the bowl axis in accordance with adjustment movements of said skimmer by said adjustment means.

22. A centrifugal separator according to claim 21 wherein said fixed support structure includes spaced apart support arms disposed at either side of said skimmer, each said support arm having at least one portion adjacent the radially inner surface of the pool, and said skimmer mounting means comprises a parallelogram type of linkage coupled to said support arms such that the adjustment movements of said skimmer enabled by said mounting means are essentially only radial to the axis of said bowl.

23. A centrifugal separator according to claim 21 wherein said feed means includes a feed pipe that is mounted for rotary movement and that extends along said bowl axis through said compartment, and said adjustment means includes means external of said bowl for rotating said feed pipe and means operatively coupling said feed pipe to said skimmer mounting means.

24. A centrifugal separator according to claim 21 wherein said skimmer comprises port structure with lip structure for disposition at the surface of said pool, and duct structure for discharging liquid removed from said pool by said skimmer port structure into said inlet to said discharge system disposed within said compartment, said duct structure being movable within said discharge system inlet radially of the bowl axis.

25. A centrifugal separator according to claim 24 wherein said discharge system comprises a tubular member fixedly mounted on a support external of said bowl and extending axially into said compartment and chamber structure secured to said tubular member in said compartment that defines said discharge system inlet, and said fixed support structure is secured to and extends radially from said chamber structure.

26. A centrifugal separator according to claim 25 wherin said feed means includes a pipe that extends axially through said tubular member and said chamber structure into a compartment in said conveyor.

27. A centrifugal separator according to claim 26 wherein said fixed support structure includes spaced apart support arms disposed at either side of said skimmer, each said support arm having at least one portion adjacent the radially inner surface of the pool, and said skimmer mounting means comprises two sets of links, each set of links being pivoted to a corresponding one of said support arms at points spaced radially of the bowl axis such that the adjustment movements of said skimmer enabled by said mounting means are essentially only radial to the axis of said bowl.

28. A centrifugal separator according to claim 27 wherein said feed pipe is mounted for rotary movement, and said adjustment means includes means external of said bowl for rotating said feed pipe and means operatively coupling said feed pipe to said skimmer mounting means.

29. A centrifugal separator according to claim 28 wherein said skimmer comprises port structure with lip structure for disposition at the surface of said pool, and channel structure for discharging liquid removed from said pool by said skimmer port structure into said inlet to said discharge system disposed within said compartment, said channel structure being movable within said discharge system inlet radially of the bowl axis.

* * * * *